US006162048A

United States Patent [19]

Griffioen et al.

[11] Patent Number: 6,162,048

[45] Date of Patent: Dec. 19, 2000

[54] DUAL ORIFICE PILOT ASSEMBLY

[75] Inventors: Robert Howard Griffioen, 66651 N. Centerville Rd., Sturgis, Mich. 49091; Randall Raymond Dillivan, Burr Oak, Mich.; Douglas Charles Johnson, Coldwater, Mich.; Don Alan Weber, Bronson, Mich.

[73] Assignee: Robert Howard Griffioen, Sturgis, Mich.

[21] Appl. No.: 09/325,904

[22] Filed: Jun. 4, 1999

[51] Int. Cl.[7] ..... F23D 14/04

[52] U.S. Cl. ..... 431/156; 431/343; 431/354; 251/206

[58] Field of Search ..... 431/12, 154, 343, 431/354, 355; 251/206

[56] References Cited

U.S. PATENT DOCUMENTS

| | | | |
|---|---|---|---|
| 562,410 | 6/1896 | Moon | 251/206 |
| 832,159 | 10/1906 | Pratt | 431/355 |
| 2,355,216 | 8/1944 | Guelson | 431/343 |
| 2,780,232 | 2/1957 | Ney | 251/206 |
| 3,747,586 | 7/1973 | Weiss | 126/110 B |
| 5,601,789 | 2/1997 | Rühl et al. | 431/242 |

*Primary Examiner*—Ira S. Lazarus
*Assistant Examiner*—Sara Clarke
*Attorney, Agent, or Firm*—Flynn, Thiel, Boutell & Tanis, P.C.

[57] ABSTRACT

A pilot assembly for producing a pilot flame including a pilot which includes a housing and a multiple orifice member mounted to the housing. The housing includes a gas flow passageway providing gas fuel from a gas source to the pilot flame. The orifice member positions one orifice in the passageway for metering the rate of gas flowing through the passageway, and hence combusted by the pilot, according to the type of gas. The orifice member can be moved relative to the housing so that another orifice is in the passageway for metering the gas when the pilot receives a different type of gas.

18 Claims, 14 Drawing Sheets

DUAL ORIFICE PILOT ASSEMBLY

FIELD OF THE INVENTION

The present invention relates to pilot assemblies and, more particularly to pilot assemblies of the type having a changeable orifice member.

BACKGROUND OF THE INVENTION

Gaseous fuel (hereafter for simplicity, gas) burning devices, such as conventional hot water heaters and gas fireplaces, typically burn natural gas or propane. Pilot assemblies are conventionally mounted in, and used to light, such gas burning devices. A conventional pilot assembly includes a pilot which continuously burns gas at a low rate to provide a pilot flame. The pilot flame in turn lights an adjacent main burner when gas is supplied to the main burner.

As a convenient example of a conventional environment for such a pilot assembly, a conventional gas fireplace GF (FIG. 11) includes a floor 8, a fireplace box 9 extending upwardly from the floor 8, and conventional fireplace hardware 10 mounted in the fireplace box 9. The box 9 encloses sufficient volume for the fireplace hardware 10 and fireplace flames. The fireplace hardware 10 includes a grate 11 (in broken lines) standing on the floor 8, imitation noncombustible logs 12 (in broken lines) resting on the grate 11, a main burner 13 mounted to the floor 8 in substantially hidden relation behind the grate 11 and logs 12, and a pilot assembly 15. The main burner has plural gas flame producing nozzles 14, some adjacent the pilot assembly 15.

A typical conventional pilot assembly 15 (FIG. 12) includes a horizontal mounting bracket 17 fixed by any conventional means, not shown, with respect to the main burner 13. The pilot assembly 15 is substantially hidden behind the main burner 13. The assembly 15 includes a pilot 19, an ignitor 21, a thermocouple 22, and a thermopile generator 23, which are fixed on, and extend vertically through, the mounting bracket 17 in side-by-side relation.

The pilot 19 (FIG. 12) includes a one piece housing 27 extending vertically through and fixed to the central portion of the bracket 17. A semirigid, metal, gas supply tube 28 connects the bottom of the pilot housing 27 through a conventional pilot valve V to a conventional gas source GS. A typical pilot valve V is spring biased closed (to block gas flow to the pilot 19), but can be opened manually and can be held open electrically (to allow gas flow to the pilot). FIG. 12 schematically shows a suitable conventional pilot valve V comprising a spring biased closed valve core Cl interposed between the gas source GS and pilot supply tube 28, and a manual opener (e.g. push button) B1 and electromagnetic hold-open (e.g. solenoid) E1 actuatable to respectively open and hold-open the valve core C1 against its spring S1.

The upper end of the pilot housing 27 normally emits a pilot flame (not shown) fueled by gas supplied through the open valve V and tube 28. A pilot flame target 31 is fixed atop the housing 27 to direct the pilot flame laterally (to the right and left and forward out to the page in FIG. 12) along paths from the target 31. The top of the ignitor 21 (FIG. 12) is adjacent one side (the left side in FIG. 12) of the target 31, for igniting gas flow therefrom to establish the pilot flame of pilot 19. The tops of the thermocouple 22 and thermopile generator 23 closely flank the target 31 (FIG. 12), so as to be in the pilot flame path from opposite sides of the target 31 and with the ignitor 21 snugly spaced between the thermocouple 22 and target 31. The front of the flame target 31 is adjacent ones of the gas outlet nozzles 14 of the main burner 13, such that the forward directed flame pilot flame component ignites gas flowing from the main burner 13.

An electrically insulated wire 24 (FIG. 12) electrically couples the bottom of the ignitor 21 to the output of a conventional ignitor voltage source, here for example a conventional, manually actuatable, push button, piezoelectric voltage source PZ, grounded to the bracket 17. Given a supply of gas through the pilot valve V to the pilot 19, manual actuation of the piezo voltage source discharges an electrical spark between the tops of the ignitor 21 and pilot 19, thereby igniting the pilot gas flow and starting the pilot flame.

A relatively stiff wire 25 extends from the bottom of the thermocouple 22 to the control input of the electromagnetic hold-open E1 of pilot valve V. The thermocouple 22, when heated by the pilot flame from pilot 19, supplies a voltage (typically in the range of millivolts) to the solenoid E1 to maintain the valve V open and so maintain gas flow to the pilot and keep the pilot flame on. If the pilot flame becomes extinguished, the thermocouple 22 cools, its voltage output drops, and the solenoid E1 relaxes and the spring S1 closes the valve V and shuts off gas flow to the pilot 19.

The bottom of thermopile generator 23 (FIG. 12) connects through a heat shielded, relatively stiff, electrically insulated wire pair 26 to a main gas safety valve MV interposed between the conventional gas source GS and the main burner 13. The thermopile generator 23 responds to pilot flame heat to electrically open the main valve MV to supply gas from the gas source GS to the main burner 13 and responds to lack of pilot flame heat to close the valve MV and thus shut off gas flow to the main burner 13. The main safety valve MV may be a conventional solenoid valve (like pilot V but without the manual opener B1) comprising a valve core C2 spring biased closed by a spring S2 and openable by a solenoid E2.

Typically, a manual control MC, in the form of a manually adjustable valve, is in series with the main safety valve MV, between the gas source GS and main burner (MB) 13, to allow the human operator of the fireplace GF to turn on and off, and vary the flame height of, the main burner MB.

The top and bottom ends of the one-piece pilot housing 27 (FIG. 13) are spaced above and below the bracket 17. The housing 27 has a radially inwardly stepped, upper housing portion 45. The housing 27 also has a stepped axial through passage 29. The passage 29 has a substantially cylindrical top portion 42, an enlarged-diameter midportion 43 and a further enlarged-diameter, bottom opening, internally threaded recess 44. The portions 42 and 43 are separated by a tapered annular step 46. The midportion 43 and recess 44 are separated by an annular step 47, the upper portion of which is tapered upward and inward. The open top 48 of the passage 29 acts as the ignited gas/air mixture (flame) outlet nozzle of the pilot 19.

The pilot flame target 31 comprises a semi-circular base 38 which is fixed, by any convenient means, such as welding, to the upper housing portion 45. The target 31 has an inverted trough-like, pilot flame deflector 39 fixedly upstanding from the base 38 and spaced above the pilot flame outlet nozzle 48 for deflecting the pilot flame laterally (to the left and right in FIG. 13) toward the ignitor 21, thermocouple 22 and thermopile generator 23 and forwardly (out of the page in FIG. 13) toward the main burner 13.

At least one air supply aperture 32 opens radially through the peripheral wall of the housing 27 and into the midportion 43 of the passage 29. The aperture 32 may be above the bracket 17 as here shown, or below it.

An inverted cup-shaped, pilot orifice-containing member 33 includes a substantially cylindrical peripheral wall 35, a horizontal top end wall 36, a central orifice 34 preferably centered in the end wall 36, and a radially outwardly and downwardly flared bottom flange 40. The orifice member 33 is assembled in the pilot housing 27 by upward insertion through the threaded bottom recess 44. When so installed, as seen in FIG. 9, the top end wall 36, with its orifice 34, is located closely below the air aperture 32, the peripheral wall 35 is in snug sliding engagement with the lower portion of the passage midportion 43, and the bottom flange 40 snugly abuts the tapered step 47.

An upper end of the pilot gas supply tube 28 is fixedly tipped by a ferrule 37 (FIG. 13) that is tapered at its upper and lower ends 51 and 52.

A spool-like, annular fitting 41 (FIG. 13) is snugly but axially and rotatably slidably sleeved on the gas supply tube 28 below the ferrule 37. The fitting 41 adjacent its lower end has a wrench-engageable (here hexagonal) rim 53. The fitting 41 is externally threaded at 54 adjacent its upper end and includes a central throughbore 55. The upper end of the fitting throughbore 55 is tapered at 56. The gas supply tube 28 is fixed to the bottom of the housing 27 by inserting the ferrule 37 into the housing bottom recess 44 until it rests against the tapered bottom flange 40 of the orifice member 33. The fitting 41 is then threaded into the threaded bottom recess 44 of the housing 27. Threadedly tightening the fitting 41 axially presses it, fitting taper 56 to ferrule taper 52, against the bottom of the ferrule 37 and in turn axially upwardly presses the ferrule 37 so that its upper taper 51 forcibly presses the bottom flange 40 against the tapered step 47 of the housing 27. This locks in place the orifice member 33 in the housing 27 and prevents leakage of gas, such that all gas from the gas supply tube 28 must pass up through the orifice 34 and mix with air from the aperture 32, and such that the resultant gas/air mixture must pass upwardly through the passage top portion 42 and out the nozzle 48 for ignition and production of the pilot flame.

However, different fuel gases differ in energy content and so require different sized orifices 34 to supply gas at different flow rates for maintaining the desired size pilot flame. Manufacturers, retailers, and repair persons must thus inventory different pilot assemblies 15 (FIG. 12) for different gaseous fuels, or must change the orifice member 33 (FIG. 13) in a given assembly if a different fuel gas than originally contemplated is to be used. Unfortunately, inventorying different pilot assemblies 15, and more importantly appliances incorporating them, is space consuming and expensive.

Also, unfortunately, in such prior pilot assemblies 15 (FIG. 12), changing the orifice member 33 (FIG. 13) is difficult and time consuming because access to the orifice member 33 is difficult before, and particularly after, the conventional pilot assembly 15 is installed in a gas burning device, for example a fireplace or water heater. More particularly, to remove the existing pilot orifice member 33, the fitting 41 and gas supply tube 28 must be removed from the bottom of the pilot 19. However, access to the fitting 41 is usually, at least partially, blocked, e.g. by the bracket 17 and main burner 13, if not additionally by user device structure, such as the nonflammable logs 12, grate 11 or fireplace box 9 (FIG. 11). Further, the stiffness of the gas supply tube 28 requires either that it be bent (thus risking kinking and disabling) away from the pilot 19, or that the bracket 17 be disconnected from supporting structure of a user device and that the relatively stiff electrical conductor members 25, 26 also be disconnected to enable access to the bottom of the pilot 19.

U.S. Pat. No. 6,027,335, filed Feb. 3, 1999 (Attorney Reference: PSE Case 1), by the owner of the present application, discloses an improved pilot assembly which effectively avoids prior art disadvantages such as those above discussed, e.g. by allowing access to the orifice member from above the mounting bracket and so greatly easing exchanging one orifice member for another to adapt the pilot assembly to gaseous fuels of different characteristics. While that improved pilot assembly has been successful in use and has rapidly gained interest in the marketplace, nonetheless a program of continuing development and improvement has now led to the present invention.

Accordingly, objects of the present invention include providing a pilot assembly having more efficient and easier conversion of the pilot orifice, and hence the pilot, from one gaseous fuel to another.

SUMMARY OF THE INVENTION

The objects and purposes of the present invention, including those set forth above, are met, according to one form of the present invention, by providing a pilot assembly which includes an orifice member having different orifices alternately fixable in the pilot gas flow to adapt the pilot assembly to properly meter different gases.

DETAILED DESCRIPTION

Figure 1:
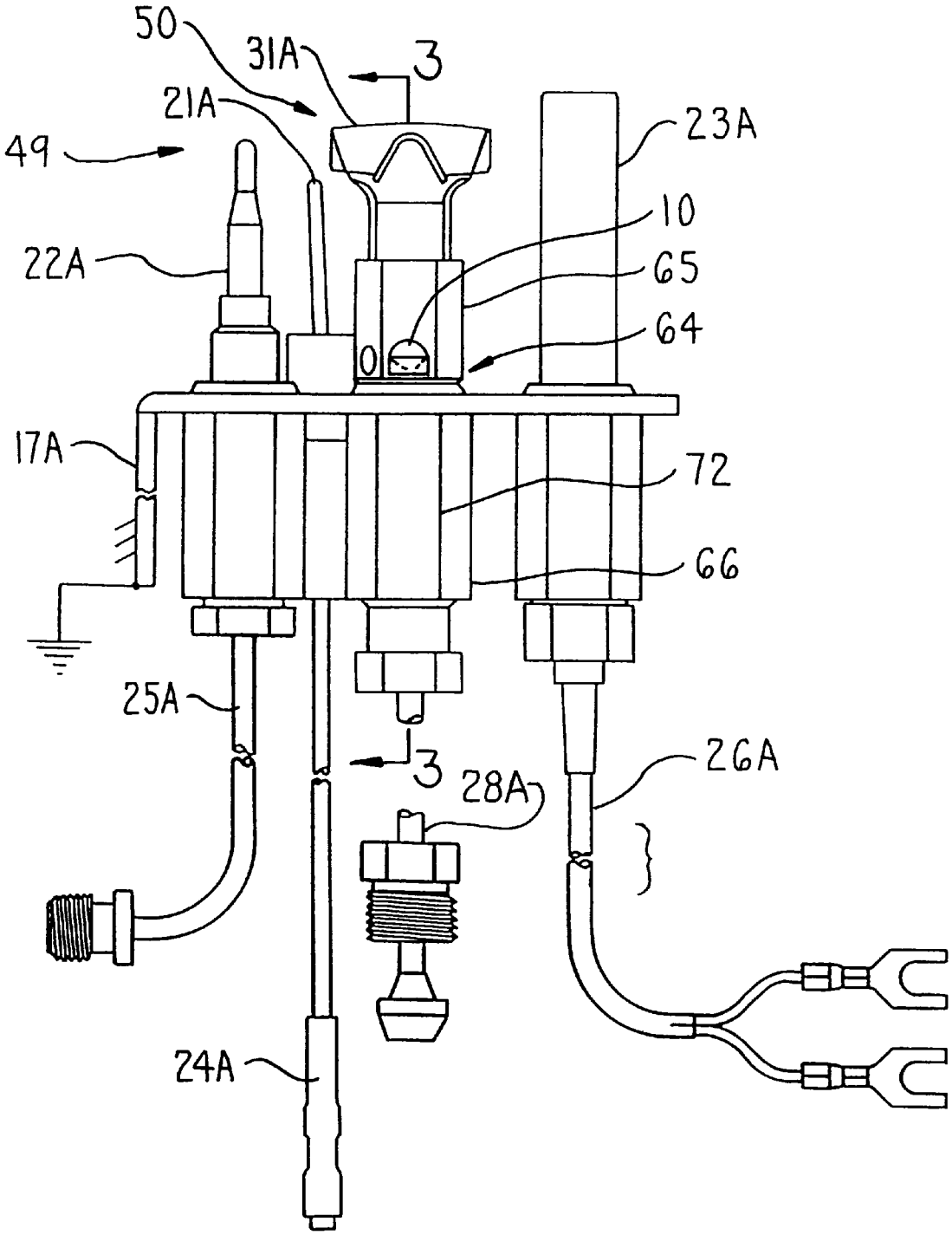
FIG. 1 is a front elevational view of a pilot assembly embodying the present invention.

Certain terminology will be used in the following description for convenience and reference only and will not be limiting unless explicitly recited in the claims. The words "up", "down", "top", "bottom" will designate directions in the drawings to which reference is made. The words "upstream" and "downstream" refer to directions relative to gas flow through the pilot. Such terminology will include derivatives and words of similar meaning.

FIG. 1 discloses a pilot assembly 49 embodying the present invention. While the present invention may be embodied in other structures, for convenience in the present disclosure, the pilot assembly 49 of FIG. 1 is described below as an improvement on, and hence modification of, the prior art pilot assembly 15 above discussed in conjunction with FIGS. 11–14. Thus, for convenient reference, parts of the inventive pilot assembly 49 (FIG. 1) substantially corresponding to parts of prior art pilot assembly 15 will be referred to by the same reference numerals, with the suffix "A" added thereto. Thus, the FIGS. 1–9 pilot assembly may be similar to that shown in FIGS. 11–14 except as follows.

Inventive pilot assembly 49 (FIG. 1) includes an improved pilot 50. The pilot 50 (FIGS. 2–5) includes a two-part housing 64 comprising a substantially tubular upper housing member 65 and a substantially tubular lower housing member 66. The pilot also includes an upper orifice seat 67, a multi-orifice (e.g. dual orifice) member 68, and lower orifice seat 69.

The lower housing member 66 (FIGS. 2–5) comprises an elongate, peripheral wall 71 including a wrench grippable (e.g. hexagonal) exterior surface 72, upper end portion 74, and bottom end 76. A coaxial, gas flow passage 78 extends through the lower housing member 66. A diametral, preferably integral, interior wall 77 divides the lower housing passage 78 into upper and lower internally threaded recesses 81, 82. The diametral wall 77 is perforated by a reduced diameter gas flow aperture 79 coaxially connecting the greater diameter upper and lower recesses 81, 82.

The lower recess 82 (FIGS. 4 and 5) is stepped radially outward and downward from the diametral wall 77. Starting from the diametral wall 77 and moving downward (upstream of the normal gas flow direction), the lower recess 82 includes an outwardly and downwardly flared tapered step 83; an increased diameter generally cylindrical wall 84; a convexly rounded, downwardly widening step 86; an internally threaded, substantially cylindrical wall 87; and an increased diameter downwardly and outwardly tapered step 88.

The upper recess 81 (FIGS. 4 and 5) is stepped radially outward and upward from the diametral wall 77. Starting from the diametral wall 77 and moving upward (along the normal gas flow direction), the upper recess 81 includes a radial step 80; a generally cylindrical wall 147; a radial step 148; an internally threaded, generally cylindrical wall 149; a radial step 150; and an increased diameter generally cylindrical wall 151.

The upper housing member 65 (FIGS. 2–5) includes an elongate, hollow, generally tubular wall 91 having upper and lower end portions 92, 93 axially flanking a midportion 94. The midportion 94 has a wrench engageable (e.g. hexagonal) outer surface. The lower end portion 93 is externally threaded at 96. The outer peripheries of the upper and lower end portions 92 and 93 are stepped radially inward from the periphery of the midportion 94. The height of the upper housing member 65 can be altered (e.g. decreased) to fit the needs of the particular environment in which it is used. The upper housing member 65 includes a coaxial through passageway 95. The passageway 95 includes a constant diameter upper portion 42A; a downward facing, tapered annular step 97; a cylindrical air/gas mixing chamber 101; a downward facing radial annular step 99; and a relatively large diameter, downward opening, lower recess 103. An air supply aperture 102 opens radially through the periphery of midportion 94 into the air/gas mixing chamber 101. A diametral bore through the midportion 94, below the tapered step 97, forms two radially outwardly opening recesses 104, 105 open to the mixing chamber 101 and lower recess 103 at the annular step 99.

The lower orifice seat 69 (FIG. 4) here comprises an elongate, generally cylindrical inverted cup-shaped member 106 having an upper end wall 107 and enclosing a gas through passage 108 extending axially therethrough. The upper surface 120 of the end wall 107 is preferably planar. The inner peripheral surface 110 of member 106 here includes a downward facing annular step 111 adjacent the end wall 107. The end wall 107 has a coaxial gas flow aperture 112.

The orifice member 68 (FIGS. 7 and 8) includes a rectangular, elongate central plate 113 and end flanges 114, 115 fixed at opposite ends of the plate 113. The plate 113 has a width generally equal to the diameter of the recesses 104, 105. The upper and lower surfaces 116 and 122 of the plate 113 are planar and parallel to each other. The flange 115 extends transverse to, and preferably extends essentially perpendicular to, the plate 113. Prior to the assembly of the pilot 50, the end flange 114 is conveniently substantially coplanar with the plate 113 to aid such assembly. The orifice member is conveniently a relatively stiff but tool-bendable strip of sheet metal, e.g. stainless steel. Gas flow control orifices 117, 118 perforate the plate 113 at centers spaced along its central length axis and are each spaced from a respective adjacent flange 114, 115 at a distance equal to the radial distance from the pilot axis 100 to the outer surface of the upper housing midportion 94. The orifices 117 and 118 are preferably sized to respectively regulate natural gas and liquid propane gas flows through the pilot 50, but can be sized for other fuels as desired. The upper surface 116 (FIG. 8) of the plate 113 adjacent the flanges 114 and 115, carries respective indicia 119 and 121 indicating the type of gas to be metered by the orifice adjacent the other flange. For example, the indicia 119 and 121 here respectively indicate "N20" for natural gas and "L14" for liquid propane. The indicia 119 and 121 may be stamped or otherwise embossed on the plate 113.

The upper orifice seat 67 (FIG. 4) comprises a disk 123 including a central, gas flow, through aperture 124 and parallel upper and lower planar surfaces 126, 127.

The pilot 50 is assembled as follows.

The lower housing member 66 (FIG. 2) includes an upper end portion 74 which is inserted upwardly snugly into a hole 128 in bracket 17A and fixed (e.g. by staking, welding, or other conventional securement technique) thereto, so that substantially all of the major length of the lower housing member 66 depends beneath the bracket, i.e. bottom end 76 is remote the bracket.

The gas supply tube 28A, ferrule 17A and fitting 41A are upwardly inserted, as a unit, into the lower recess 82. The fitting 41A is then tightly threaded into the recess 82, so that the tapered upper end 51A of the ferrule 37A is sealingly seats against the tapered step 86 of the lower housing member 66.

The lower orifice seat 69 (FIG. 2) is inserted downwardly into the upper recess 81 of the lower housing member 66 so that its open bottom end 130 seats on the annular, upwardly facing step 80 of the diametral wall 77. As a result, the upper end 120 of the lower orifice seat 69 is positionally fixed relative to the lower housing 66 and bracket 17A, and an annular gap 131 separates the upper portion of the lower orifice seat 69 and the upper portion 74 of wall 71. Thus, the upper surface 120 of the lower orifice seat 69 is spacially fixed with respect to the lower housing member 66, bracket 17A, and the gas combustion device environment.

The upper orifice seat 67 (FIG. 2) has an outer diameter essentially equal to or slightly less than the diameter of the lower recess 103 of the upper housing member 65 and is upwardly inserted in the lower recess 103 so that its upper surface 126 seats against the annular step 99. The upper orifice seat 67 may be fixed in that position, for example by a snap or preferred press fit.

Figure 2:
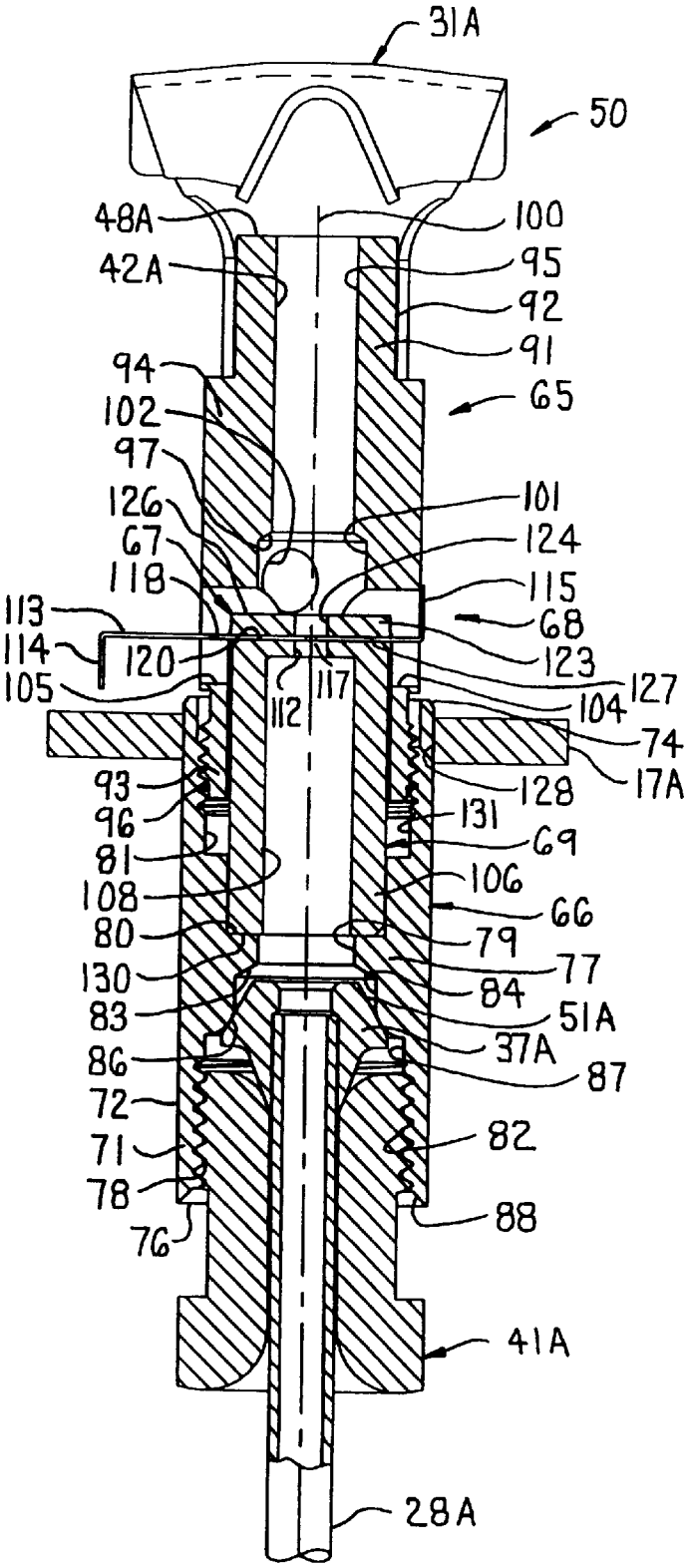
FIG. 2 is a central cross sectional view taken from the front, of the pilot of FIG. 1.

The dual orifice member 68 (FIG. 8) is installed in the pilot 50 as follows. The substantially coplanar flange 114 and plate 113 are inserted (as seen in FIG. 2) through one recess (e.g. recess 104) diametrically past the pilot axis 100 and beneath the upper orifice seat 67, and out through the opposing recess (e.g. recess 105). The orifice member 68 continues to be inserted into the recesses 104, 105 until the transversely extending flange 115 contacts the outer peripheral surface of the midportion 94 of the upper housing 65. The upper surface 116 of the plate 113 closely underlies the lower surface 127 of the upper orifice seat 67.

Then, the resulting upper housing member assembly 132 (FIG. 9), including upper housing member 65, upper seat 67 and the orifice member 68, is placed on a support die 135. The lower portion 93 of the upper housing member 65 is seated in a recess 134 of the die 135. The portion of the plate 113 adjacent the substantially coplanar flange 114 rests on an anvil 136 of the support die 135. Thereafter, a movable die 137 wipes downwardly along the side of the anvil 136 and bends the flange 114 downward so that the flange 114 is transverse to and preferably perpendicular to the plate 113, as shown in dotted line in FIG. 9. The assembly 132 is then removed from the dies 135 and 137. Consequently, both flanges 114, 115 extend transverse to the plate 113 and are essentially parallel to the axis 100 of the assembled pilot 50. Both flanges 114, 115 have a length which causes the flanges to contact the outer periphery of the upper housing 65 so as to prevent the orifice member 68 from being slid out of the recesses 104, 105. That is, and for example, if the plate 113 extends in a central horizontal diametral plane through the recesses 104, 105, then each of the flanges 114, 115 has a minimum length equal to the radius of the recesses 104, 105.

Thereafter, the threaded lower portion 93 (FIG. 2) of the upper housing member 65 is loosely inserted downward in the annular gap 131 and loosely threaded into the internally threaded upper recess 81 of the lower housing member 66. The upper housing member 65 is now nearly fully installed in the lower housing member 66, with the central plate 113 of the orifice member 68 located longitudinally slidably between the lower surface 127 of the upper orifice seat 67 and the upper surface 120 of the lower orifice seat 69. The plate 113, lower surface 127 and upper surface 120 are parallel to each other and preferably perpendicular to the axis 100.

The desired gas flow control orifice 117 or 118 (e.g. flange 117 in FIG. 2), is positioned coaxially of the axis 100 and apertures 112 and 124, by pushing one end of the member 68 diametrally inwardly of the pilot 50, so that the corresponding flange 114 or 115 (e.g. flange 115 in FIG. 2) abuts the outer surface of the upper housing midportion 94.

Thereafter, the upper housing member 65 is further and completely threaded into the upper recess 81 of the lower housing member 66. As a result, the orifice member 68 is fixed in the pilot 50 by the final downward displacement of the upper housing member 65 in the lower housing member 66, and resulting in a tight sandwiching of the plate 113 between the lower surface 127 of the upper orifice seat 67 and the upper surface 120 of the lower orifice seat 69 so that the plate 113 is fixed therebetween.

The threads of the lower housing upper recess 81 and upper housing lower portion 93 intermesh so that, with the pilot 50 mounted in the pilot assembly 49 as shown in FIG. 1, the target 31A directs the flame toward the thermocouple 22A, thermopile generator 23A and the main burner.

OPERATION

Figure 3:
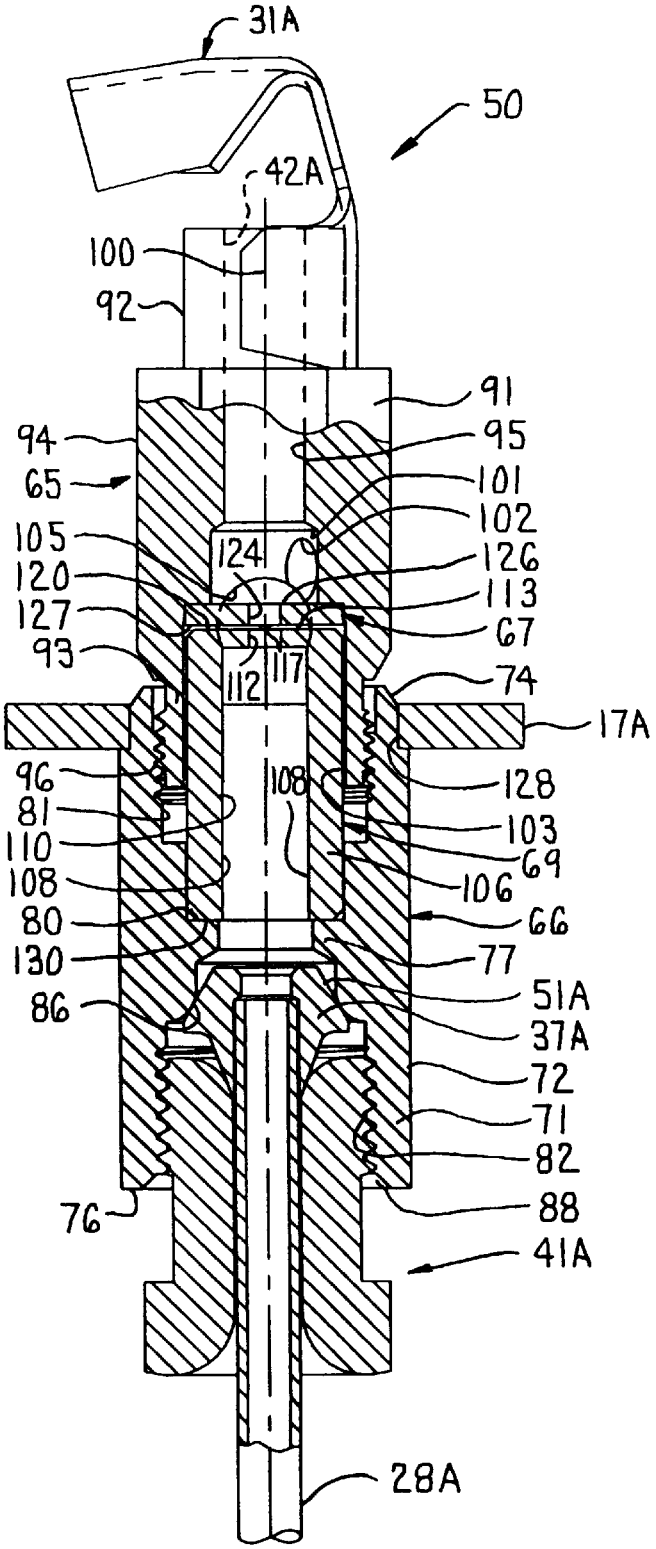
FIG. 3 is a central cross sectional view substantially as taken on the line 3—3 of FIG. 1.
Figure 4:
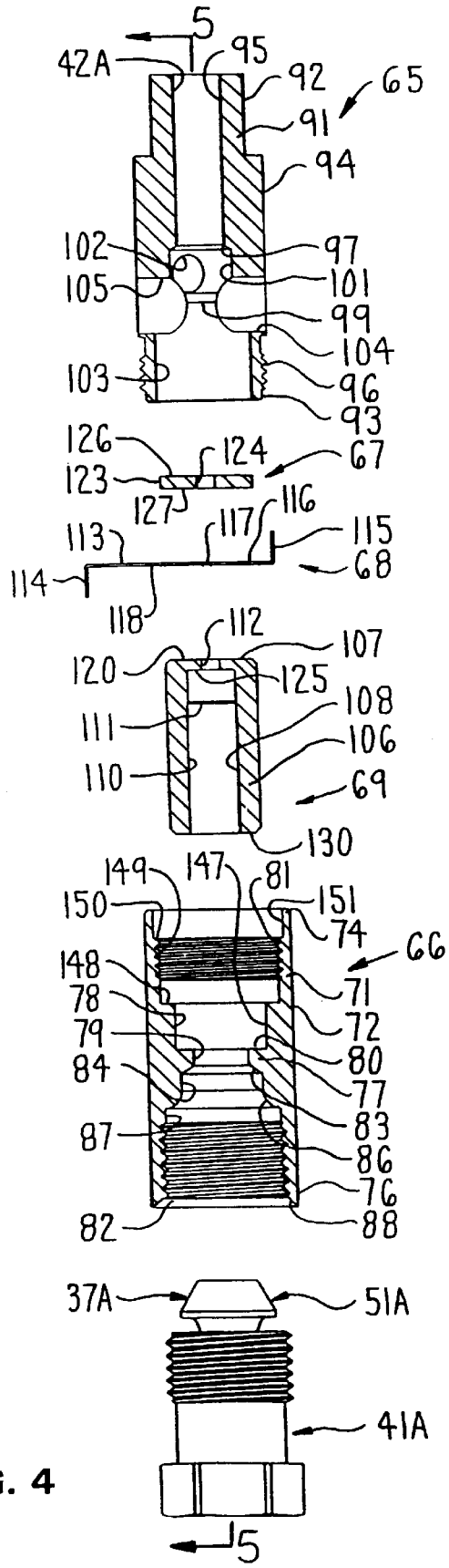
FIG. 4 is an exploded view of the pilot of FIG. 2.
Figure 5:
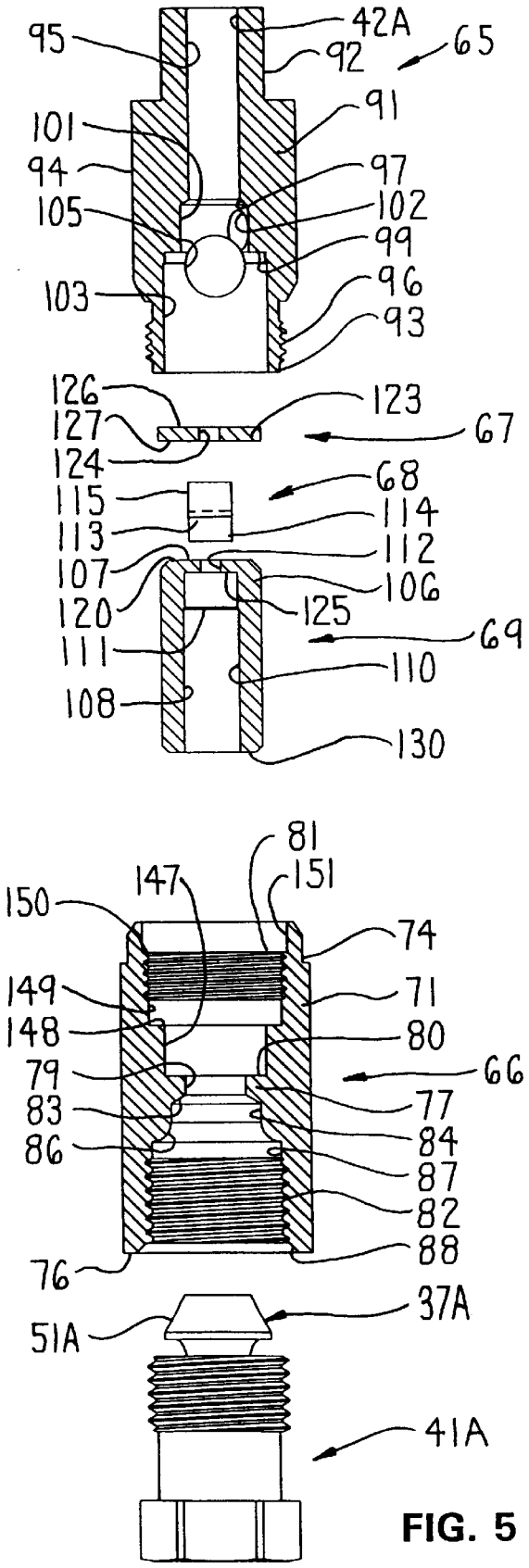
FIG. 5 is a central cross sectional view substantially as taken on the line 5—5 of FIG. 4.
Figure 6:
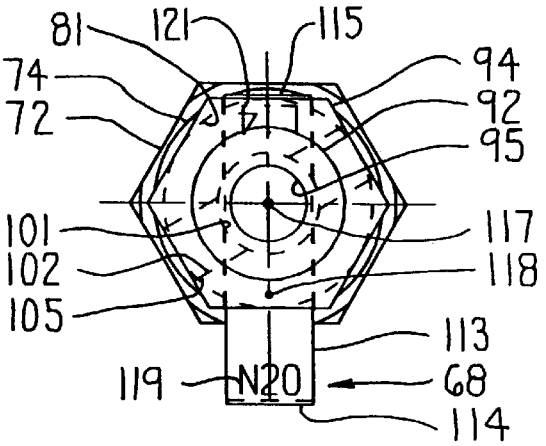
FIG. 6 is a top view of the pilot with the pilot target removed.

In use, the gas supply tube 28A supplies gas, upwardly as shown in FIGS. 2 and 3, through the ferrule 37A and into the passage 78 in the lower housing member 66. Gas flows through the aperture 79 and into the passage 108 in the lower orifice seat 69. The gas thereafter flows into the aperture 112. The orifice 117 meters the gas flow to the aperture 124. The metered gas flow then enters the mixing chamber 101, in which air from the air aperture 102 and recesses 104 and 105 mixes with the gas. The gas/air mixture then flows through the upper portion 42A of the upper housing passageway 95 and exits the outlet 48A where it is ignited and forms a pilot flame directed by target 31A.

The present invention allows changing the pilot 50 to a different fuel requiring a different size orifice for proper gas flow regulation (metering), without taking apart the pilot 50. For example, the upper housing member 65 need not be removed from the lower housing member 66. Further, the pilot 50 need not be removed from the bracket 17A. Additionally, the bracket 17A need not be removed from its environment, e.g. fireplace.

More specifically, to change the pilot orifice, the upper housing member 65 is partially unthreaded relative to the lower housing member 66, typically by less than one rotation, and enough so that the upper orifice seat 67 no longer axially fixedly clamps the dual orifice plate 113 against the fixed upper surface 126 of the lower orifice seat 69. The orifice plate 113 becomes thus longitudinally slidable between the upper and lower orifice seats 67 and 69. Thereafter, the user slides orifice member 68 from its position shown in the drawings (wherein orifice 117 is metering gas flow) by pushing the outwardly extending end, i.e. at flange 114, radially inwardly of the pilot 50, to abut the flange 114 against the outer surface of the upper housing member 65. As a result, the alternative orifice 118 becomes coaxially aligned with the axis 100 and apertures 112, 124 to meter gas flow, instead of the orifice 117. In the same manner, the user may shift the orifice member 68 in the opposite direction to meter gas flow with the orifice 117 rather than the orifice 118.

Once the desired orifice 117 or 118 is coaxial with the apertures 112 and 124, the user rotates the upper housing member 65 sufficient to tighten its threaded connection to the lower housing member 66 and thus fixedly clamp the orifice member 68 between seats 67, 69.

MODIFICATION

Figure 10:
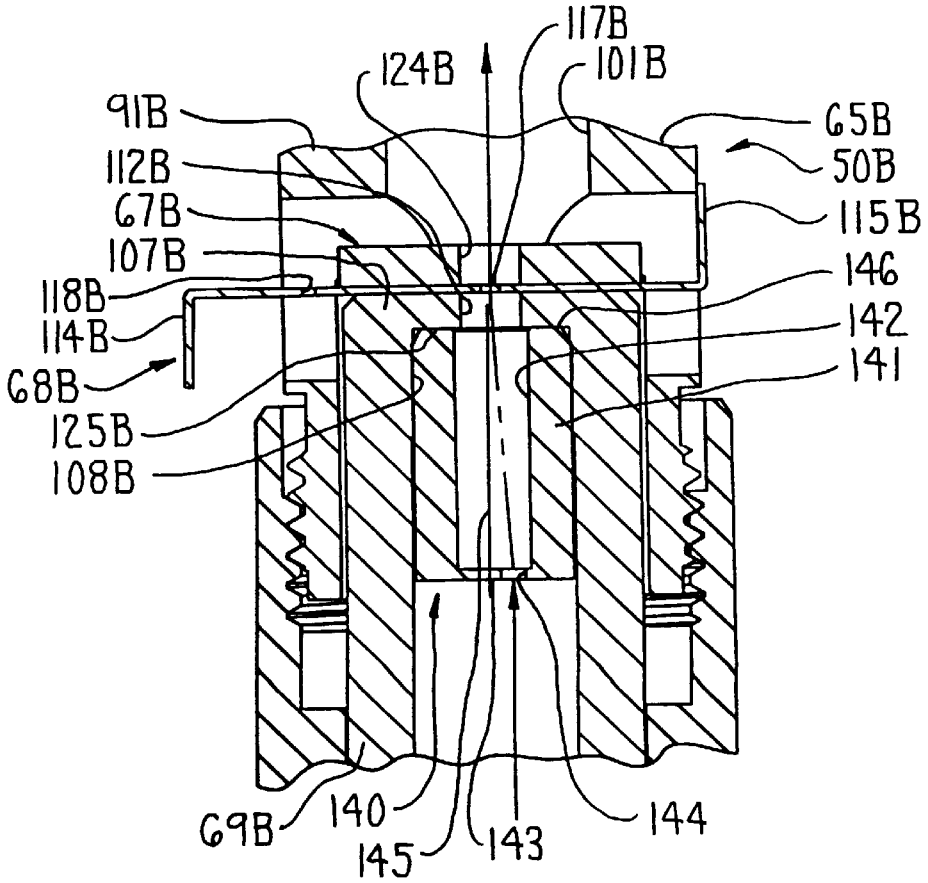
FIG. 10 is a fragmentary enlarged view of a modification of the FIG. 1 pilot.
Figure 8:
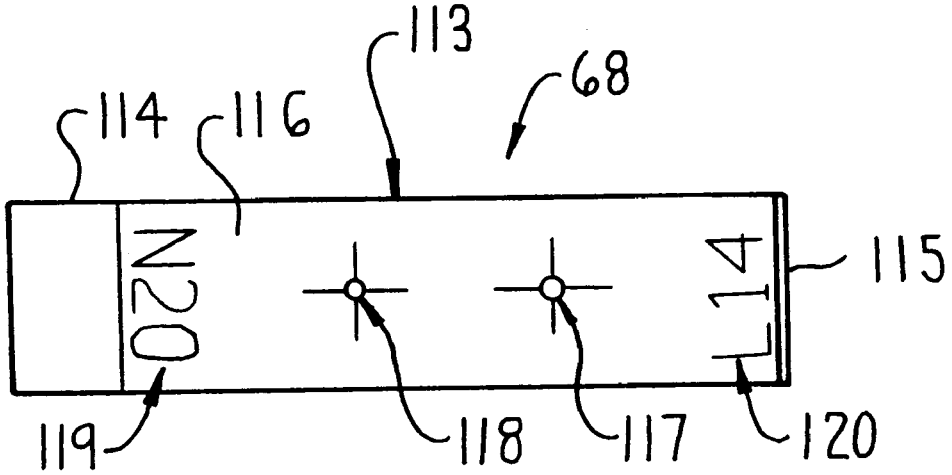
FIG. 8 is a top view of the orifice member of FIG. 7.
Figure 7:
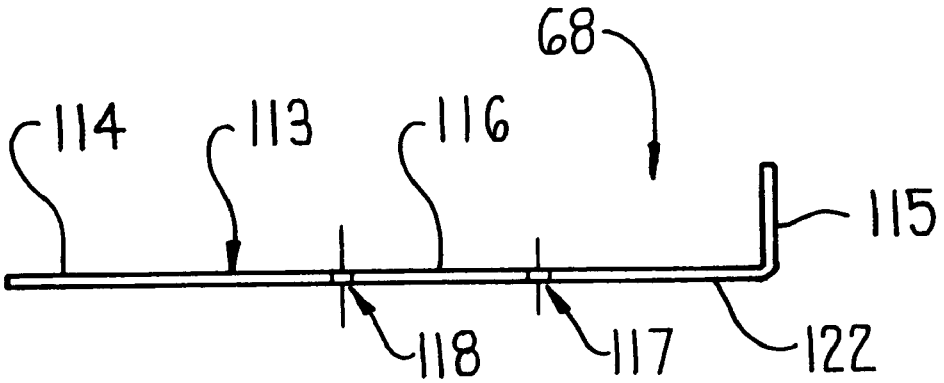
FIG. 7 is an enlarged front elevational view of the orifice member of FIG. 2, during a step of manufacture.
Figure 9:
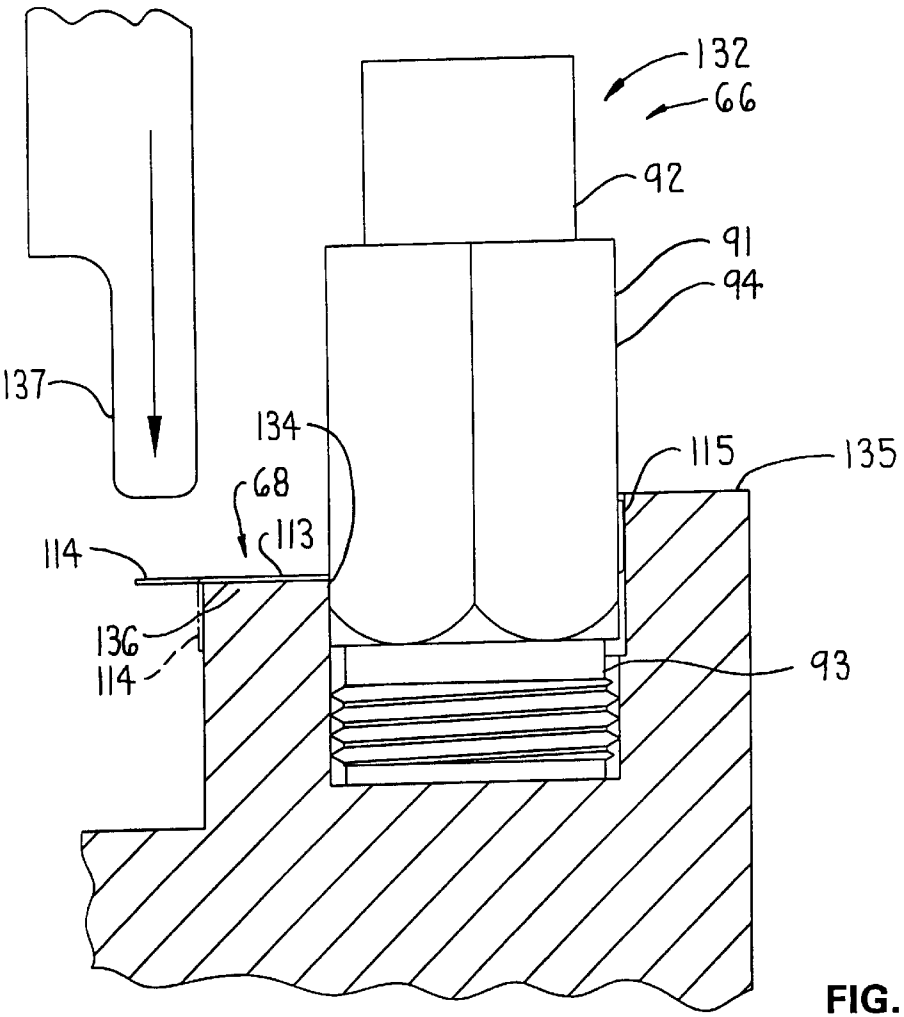
FIG. 9 is a diagrammatic view of a manufacturing step performed on the orifice member of FIG. 7.
Figure 11:
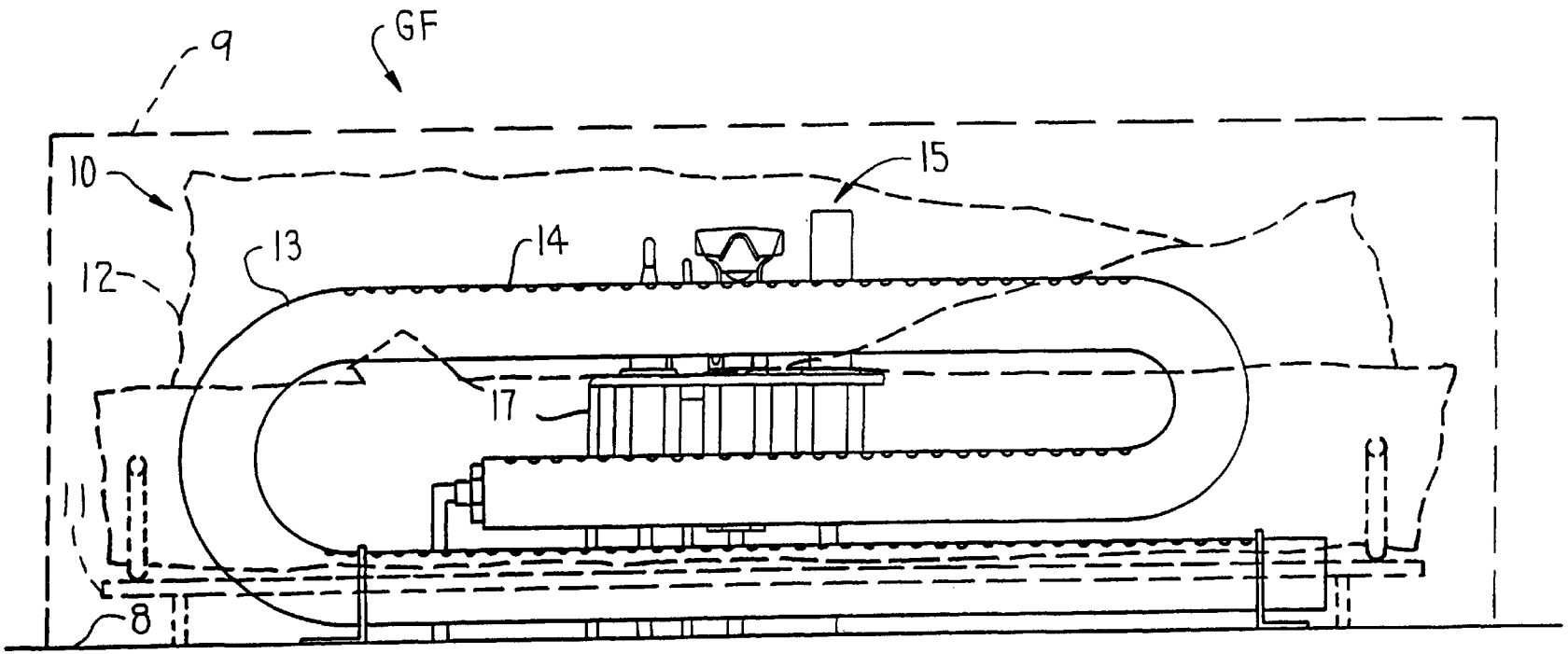
FIG. 11 PRIOR ART
FIG. 11 is a front view of a typical conventional fireplace, equipped with a prior art pilot assembly, and with the fireplace box, grate and non-flammable log shown in broken line.
Figure 12:
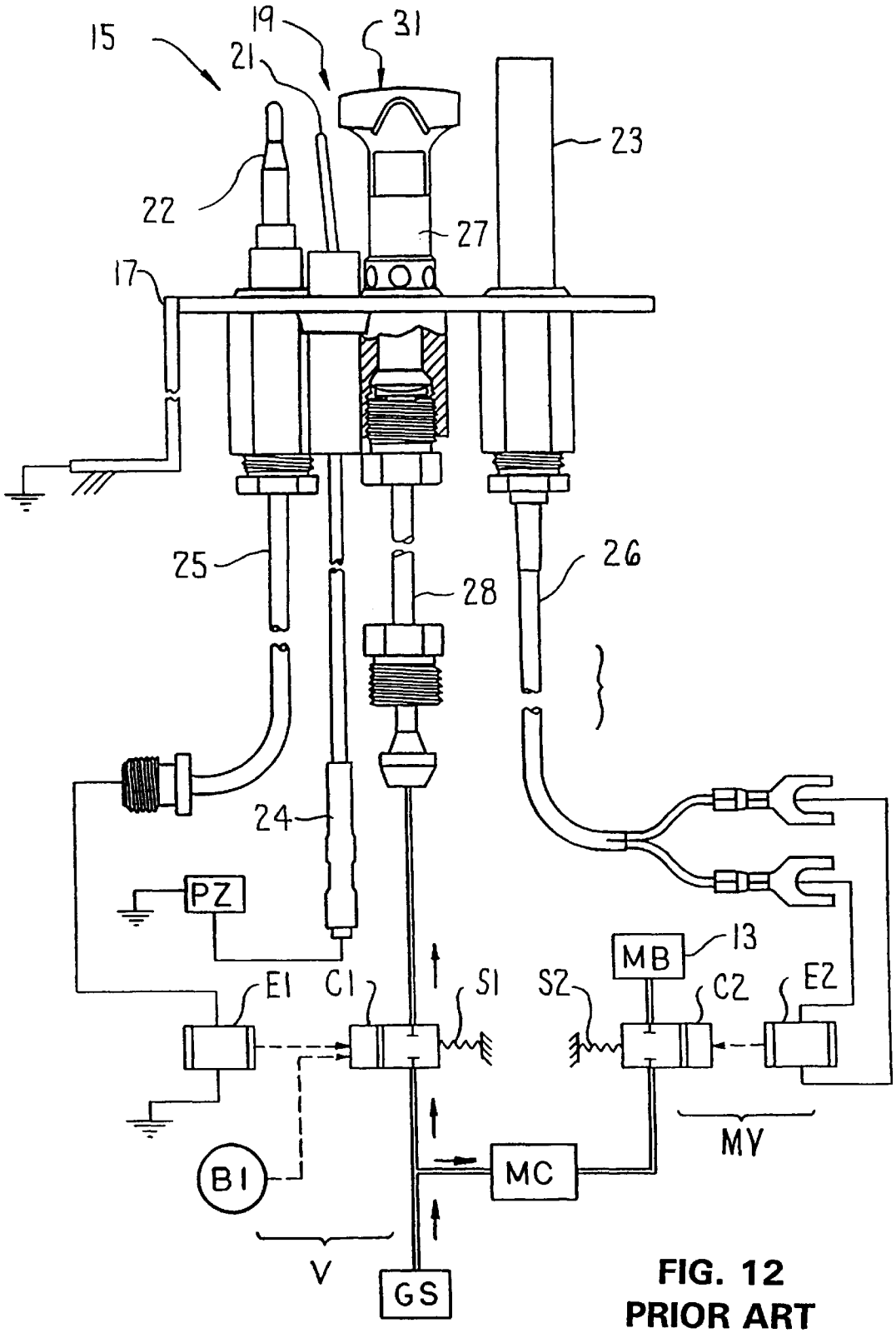
FIG. 12 PRIOR ART
FIG. 12 is a partially broken front view of the prior art pilot assembly of FIG. 11.
Figure 13:
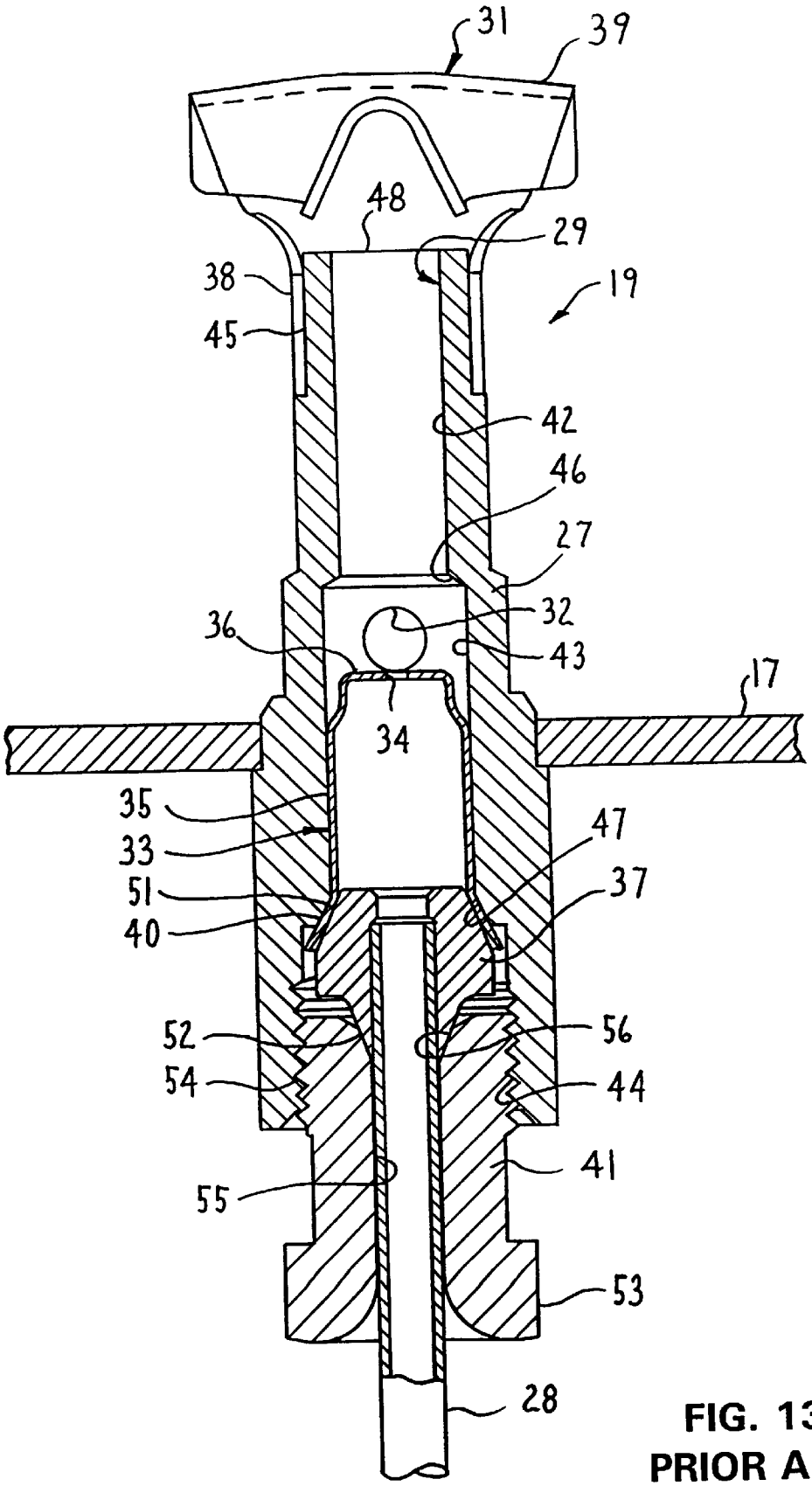
FIG. 13 PRIOR ART
FIG. 13 is a central cross sectional view of the prior art pilot of FIG. 12, taken from the front.
Figure 14:
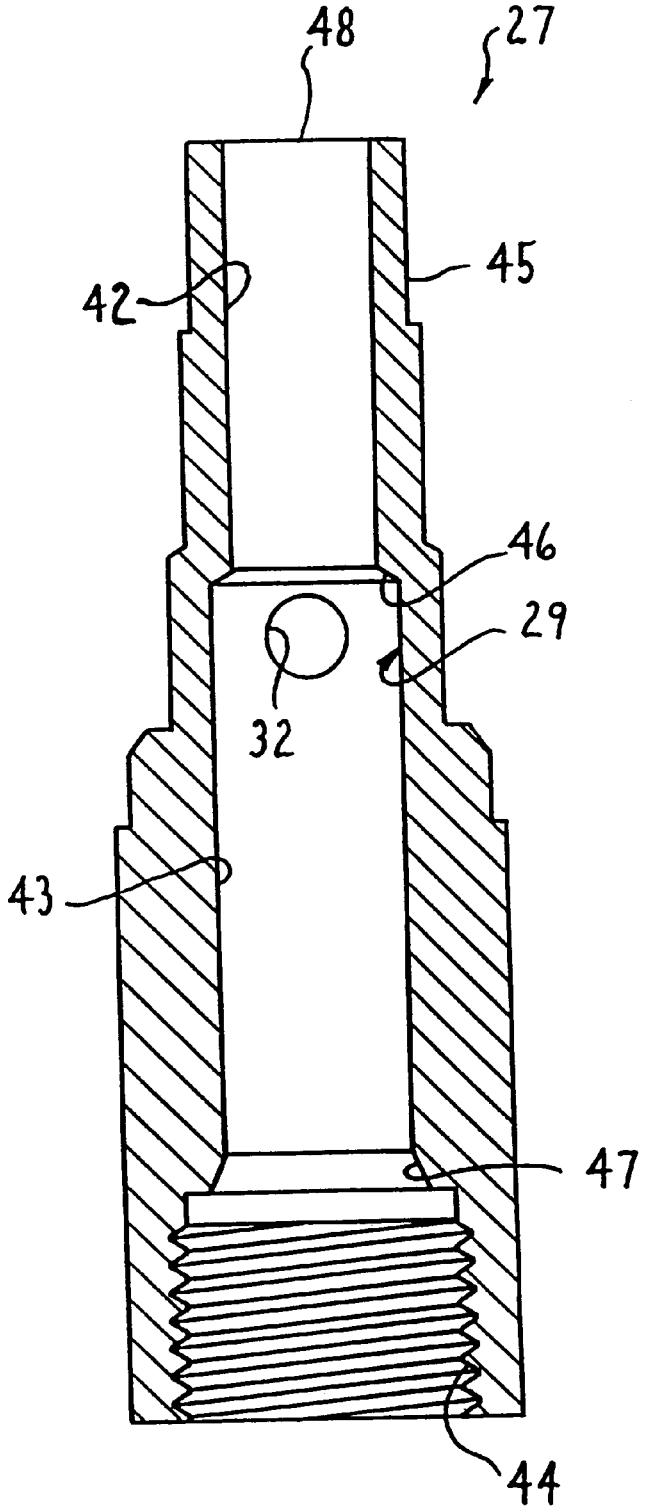
FIG. 14 PRIOR ART
FIG. 14 is a central cross sectional view of the housing of FIG. 13.

A modification of the pilot 50 is shown in FIG. 10. Elements that are similar to those described above are designated by the same reference numerals with the suffix "B" added thereto. The modified pilot 50B (FIG. 10) differs from the above described FIGS. 1–8 pilot 50 as follows.

The modified FIG. 10 pilot 50B includes an added conventional secondary gas flow barrel 140. The barrel 140 is generally cup-shaped and has a cylindrical peripheral wall 141 enclosing a coaxial, gas flow through passageway 142 and a diametral end, here wall 143, including a preferably cylindrical, gas flow aperture 144 offset laterally from the central longitudinal axis 145 of the barrel. The barrel 140 is snugly fixed in the passage 108B, e.g. as by a press fit, so that it is coaxial to pilot axis 100B. The open end 146 of the barrel 140 abuts the inner end surface 125B of the end wall 107B of the lower orifice seat 69B.

In use, gas flow upward in the passage 108B of the lower orifice seat 69B must first pass through the radially offset gas aperture 144 and gas passageway 142, before it reaches the on-axis gas aperture 112B in the lower orifice seat 69B. The eccentric location of the aperture 144 and its axial spacing from the aperture 112B by the passage 142 creates turbulence in the gas flow into the mixing chamber 101B, and thus improves mixing of gas and air in chamber 101B. Thereby, the quality of the pilot flame produced by the pilot 50B is improved.

FURTHER MODIFICATION

Figure 15:
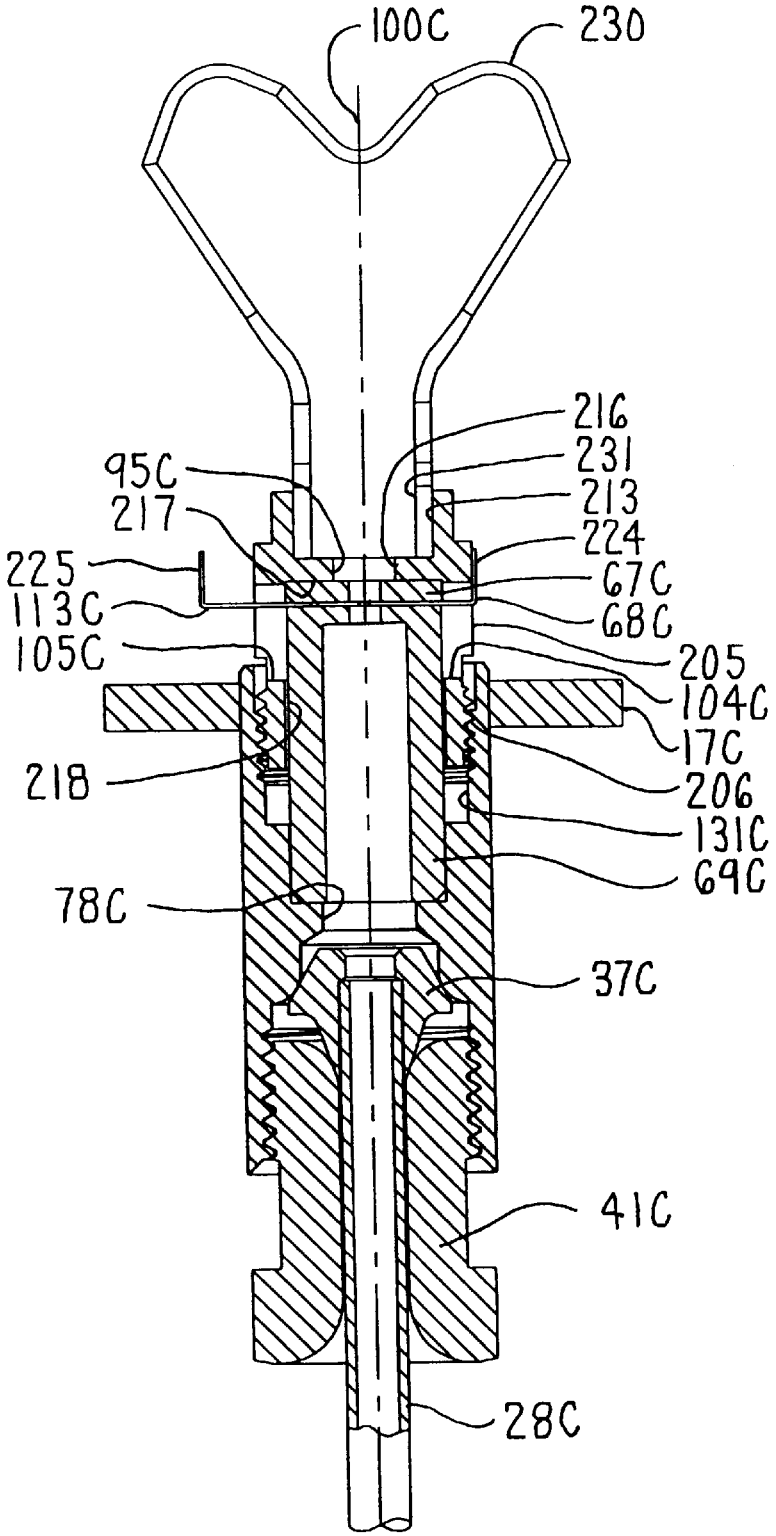
FIG. 15 is a central cross sectional view of a second modified pilot taken from the front.
Figure 16:
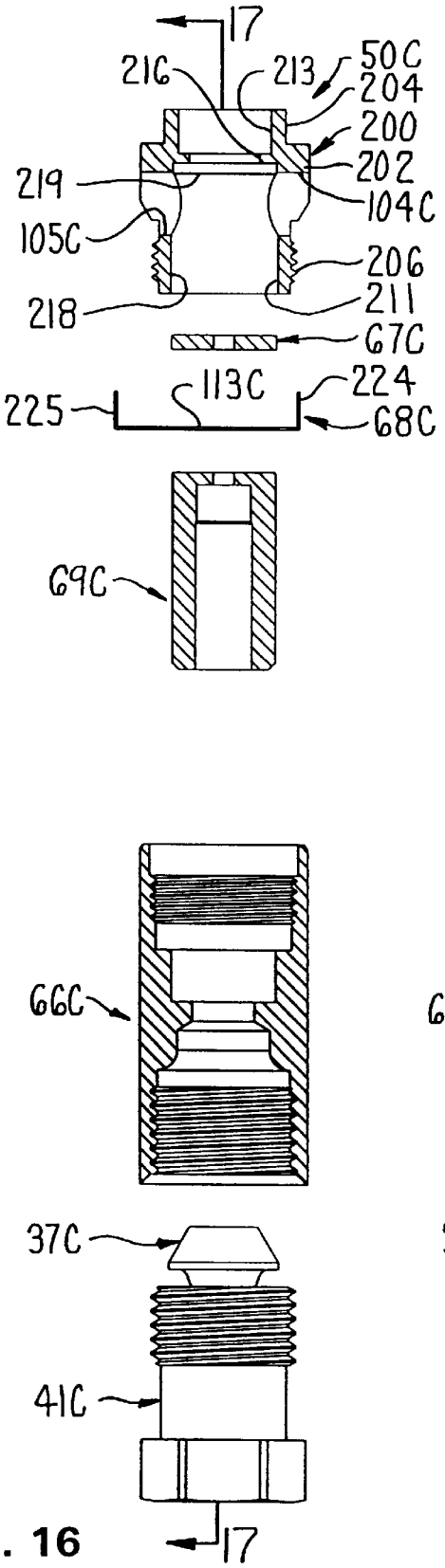
FIG. 16 is an exploded view of the FIG. 15 pilot.
Figure 17:
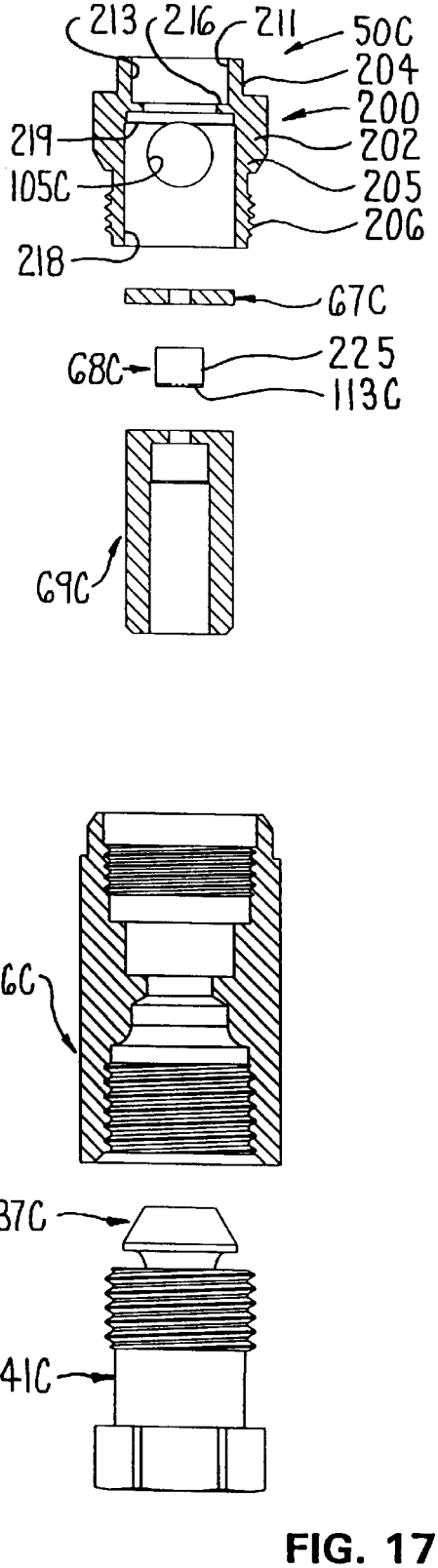
FIG. 17 is a central cross sectional substantially as taken on the line 17—17 of FIG. 16.

A further modification of the inventive pilot 50 is shown in FIGS. 15–17. Elements that are the same as those described above are designated by the same reference numerals with the suffix "C" added. The modified pilot 50C differs from the above described pilot 50 as follows.

The modified pilot SOC is intended for use in hot water heaters.

The upper housing member 200 of the modified pilot 50C includes a shortened generally tubular peripheral wall 202 comprising upper and lower wall portions 204 and 206 flanking and radially inset from a wrench engageable midportion 205. The mid and upper wall portions 204 and 205 are greatly shortened compared to the FIG. 3 upper housing member 65. The midportion 205 rises only slightly above the diametrally aligned recesses 104C, 105C and the upper portion 204 extends only briefly thereabove.

The longitudinally extending through passage 211 of the upper housing member 200 comprises, from the top end of member 200 to the bottom end downwardly, a short cylindrical wall 213, a radially inwardly extending annular flange 216, an annular downward facing retaining step 219 spaced below the flange 216, and a larger diameter cylindrical wall 218. The recesses 104C, 105C extend beneath the step 217 and through a part of the retaining step 219.

A modified orifice member 68C includes flanges 224, 225 which both extend in the same direction, here upwardly, after assembly. It will be recognized that the flanges 224, 225 can also both extend downwardly. The seats 67C and 69C and orifice member 68C are located higher in the recesses 104C and 105C and indeed the upper seat 67C abuts the bottom 217 of the flange 216 above the recesses 104C and 105C. This and the upward direction of both orifice member flanges 224 and 225 allow the orifice member 68C to clear the top of the bracket 17C.

The flanges 224 and 225 both have a height less than the height of the recesses 104C, 105C, and so can be formed prior to assembly of the modified pilot 50C. The flanges 224, 225 act as stops which, upon abutting the housing peripheral wall, precisely center the respective orifice in the gas flow passage 78C, 95C for respective metering of gas flow through the pilot 50C.

The modified target 230 is bidirectional and its semicylindrical mounting base 231 is fixed within the upper wall 213 atop the flange 216 by any conventional means, for example welding.

The pilot 50C is assembled the same as the above pilot 50 except as follows. The upper orifice seat 67C is inserted upwardly into the passage 211 within the lower wall 218 and pressed axially past the retaining step 219 which holds the seat 67C in the passage 211 against the flange 216. The flanges 224, 225 have a height less than the diameter of recesses 104C, 105C less any portion of the upper orifice seat 67C which covers part of the recesses 104C, 105C. Then, the orifice member 68C is diametrally inserted through the recesses 104C, 105C with the flanges 224, 225 extending upward. The lower orifice seat 69C is received within the cylindrical wall 218 as the lower portion 206 is threaded down into lower housing member 66C.

Although a particular preferred embodiment of the invention have been disclosed in detail for illustrative purposes, it will be recognized that variations or modifications of the disclosed apparatus, including the rearrangement of parts, lie within the scope of the present invention.

The invention claimed is:

1. A pilot assembly for producing a pilot flame in a gas combustion device, comprising:

a mount adapted to fix the assembly to a gas combustion device;

a first housing fixed to said mount and including a first through passage which is adapted to receive gas from a gas source, said first housing also including a first recess in said first passage;

a first seat member received in said first recess;

a second housing movably secured to said first housing and including a second through passage which receives gas from said first passage and supplies the gas to a pilot flame, said second housing also including a second recess in said second passage;

a second seat member received in said second recess;

an orifice member mounted between said first and second seat members to meter gas flow into said second passage to create a pilot flame, said orifice member including at least two different orifices, said orifices being respectively sized to meter gas flow of different types of gas;

said second housing having a first location relative to said first housing which fixes said orifice member with one said orifice communicating said first and second passages to meter gas flow therebetween, said second housing having a second location relative to said first housing which releases said orifice member to allow movement of said orifice member to communicate a second said orifice between said first and second passages and thus to meter gas flow for a different gas supplied to said first passage.

2. A pilot assembly according to claim 1, wherein said second housing is axially adjustably located on said first housing to move from said first location to said second location and release axial pressure of said first and second seat members on said orifice member and allow said orifice member to move.

3. A pilot assembly according to claim 1, wherein said orifice member includes an elongate central plate extending laterally through and shiftable laterally of said second housing between first and second positions so as to position one said orifice in communication between said first and second passages, said orifice member also including first and second flanges adjacent respective ends of said plate, said first and second flanges extending transverse to said plate on opposite exterior sides of said second housing, said first flange contacting an outer periphery of said second housing with said plate in said first position, and said second flange contacting said outer periphery of said second housing with said plate in said second position.

4. A pilot assembly according to claim 1, wherein said orifice member comprises a bent sheet metal strip including a central part carrying said orifices and at least one end flange bending away from said central part.

5. A pilot assembly according to claim 4, wherein said second housing includes a transverse through opening, and said orifice member extends through said transverse opening and includes first and second said end flanges bent from opposite first and second ends of said central part, said central part being received in said second housing so as to selectively align one of said orifices between said first and second through passages, and said first and second flanges extend outside of said second housing and act as stops preventing said orifice member from being removed from said second housing.

6. A pilot assembly according to claim 1, wherein said orifice member comprises a central part received in said second housing and carrying said orifices and at least one flange bending away from said central part for contact against said second housing to stop removal of said central part from said second housing in a first direction.

7. A pilot assembly according to claim 1, wherein said first seat member includes a first seat surface, said second seat member includes a second seat surface parallel to said first seat surface, said orifice member extending between said first and second seat surfaces.

8. A pilot assembly according to claim 1, wherein said first recess includes a threaded, relatively larger diameter portion and a smaller diameter portion upstream of said increased diameter portion, said first seat member is elongate and tubular and is supported in said smaller diameter portion of said first recess, a gap being formed between said first seat member and said larger diameter portion, said gap receiving an externally threaded portion of said second housing member, said second housing being threaded tightly onto said first housing to fix said orifice member with a given said orifice positioned between said first and second passages.

9. A pilot assembly according to claim 1, wherein said second housing is elongate and includes a transverse opening extending therethrough, said orifice member extending through said transverse opening and including flanges which locate said orifice member laterally on said second housing in alternate positions at which different said orifices meter the gas flow to said second passage.

10. A pilot assembly according to claim 9, wherein said second passage includes an air-gas mixing chamber positioned upstream of said orifice member, said mixing chamber being open to and receiving air from said transverse opening.

11. A pilot assembly according to claim 1, wherein said second housing includes a peripheral wall bounding said second passage and an air-gas mixing chamber in said second passage, an aperture extending through said peripheral wall into said mixing chamber for providing air.

12. A pilot assembly according to claim 1, wherein said first housing comprises a diametral wall dividing said first passage into said first recess and a third recess joined by an aperture through said diametral wall, said first recess being open to and receiving gas from a gas source, and said first seat member being supported by said diametral wall.

13. In combination, a gas burning device including a main burner which receives gas from a gas source, and a pilot assembly for providing a pilot flame for igniting gas at a nozzle of said main burner, said pilot assembly comprising:

a mounting bracket fixed with respect to said gas burning device, said bracket including first and second sides, said first side being remote from said nozzle;

a first housing fixed to said bracket and extending from said first side, said first housing including a first axial through passage and a diametral wall dividing said first passage into first and second recesses joined by an aperture through said diametral wall, said first recess receiving gas from the gas source;

a first seat member mounted in said second recess so as to create a gap between the periphery of said second recess and the outer periphery of said seat;

a second housing received in said gap and including a second axial through passage;

a second seat member mounted in said second passage;

an orifice member normally fixed between said first and second seat members and including at least two orifices respectively sized for metering different gases, said orifice member being fixed in a first position between said first and second seat members with one said orifice interposed in one of said first and second passages to meter the gas flow therethrough; and said orifice member having a second position between said first and second seat members with a second said orifice interposed in one of said first and second passages to meter the gas flow therethrough.

14. A pilot for producing a pilot flame in a gas burning device, comprising:

an elongate housing adapted to be mounted in a gas burning device, said housing including a through passage for gas flow and a transverse passage intersecting said through passage, and a gas flow regulating, sheet metal strip having a flat central portion and a first end portion bent to extend transverse to said central portion, said central portion extending in said transverse passage intersecting said through passage for regulating gas flow, said first end portion extending axially along the outside of said housing, said strip having an intermediate portion of a bendable, nonelastic metal joined to said central portion and a second end portion joined to said intermediate portion remote said central portion, said sheet metal strip having a first configuration with said second end portion substantially parallel to said central portion and a second configuration with said intermediate portion bent so that said second end portion extends transverse to said central portion.

15. The pilot according to claim 14, wherein said first end portion is perpendicular to said central portion.

16. The pilot according to claim 14, wherein said second end portion, in said second configuration of said sheet metal strip, extends axially along the outside of said housing.

17. The pilot according to claim 16, wherein said housing includes first and second members each having a gas flow through passage, said sheet metal strip being interposed between said passage in said first member and said passage in said second member, said first and second members being joined in alternative first and second positions, such that in said first position said sheet metal strip is fixed and in said second position said sheet metal strip is slidable.

18. The pilot according to claim 17, wherein said strip includes first and second orifices each adapted to regulate gas flow of a different type of gas from said gas flow passage in said first member into said gas flow passage in said second member, said strip being freely slidable to alternately position said orifices in communication with said gas flow passages with said second member and said first housing member in said second position.

* * * * *